US008622013B2

(12) United States Patent
Keller

(10) Patent No.: US 8,622,013 B2
(45) Date of Patent: Jan. 7, 2014

(54) SAILBOARD STEP DESIGN WITH LESS VENTILATION AND INCREASED SPEED

(76) Inventor: John H. Keller, Newburgh, NY (US)

( * ) Notice: Subject to any disclaimer, the term of this patent is extended or adjusted under 35 U.S.C. 154(b) by 180 days.

(21) Appl. No.: 13/119,035

(22) PCT Filed: Sep. 16, 2009

(86) PCT No.: PCT/US2009/057138

§ 371 (c)(1),
(2), (4) Date: Mar. 5, 2011

(87) PCT Pub. No.: WO2010/033579

PCT Pub. Date: Mar. 25, 2010

(65) Prior Publication Data

US 2011/0197798 A1 Aug. 18, 2011

Related U.S. Application Data

(60) Provisional application No. 61/097,836, filed on Sep. 17, 2008, provisional application No. 61/165,472, filed on Mar. 31, 2009.

(51) Int. Cl.
*B63B 1/32* (2006.01)

(52) U.S. Cl.
USPC ..... 114/291; 441/65

(58) Field of Classification Search
USPC ..... 114/288, 291; 441/65, 74
See application file for complete search history.

(56) References Cited

U.S. PATENT DOCUMENTS

| | | | | |
|---|---|---|---|---|
| 2,162,705 | A | 6/1939 | Diehl | |
| 3,111,695 | A | 11/1963 | Kelly, Jr. | |
| 3,323,154 | A * | 6/1967 | Lambach | 441/74 |
| 6,318,286 | B1 | 11/2001 | Nakashima et al. | |
| 6,595,151 | B2 * | 7/2003 | Keller | 441/74 |
| 6,666,160 | B1 | 12/2003 | Oerneblad | |
| 6,718,897 | B1 | 4/2004 | De Bello | |
| 7,685,959 | B1 * | 3/2010 | Sanders | 114/288 |
| 2002/0178984 | A1 | 12/2002 | Keller | |
| 2004/0132361 | A1 | 7/2004 | Dalton | |
| 2005/0087120 | A1 | 4/2005 | Kalil | |

FOREIGN PATENT DOCUMENTS

| | | |
|---|---|---|
| EP | 0 059 345 | 9/1982 |
| EP | 1 002 714 | 5/2000 |

* cited by examiner

*Primary Examiner* — Lars A Olson
(74) *Attorney, Agent, or Firm* — Whitham, Curtis, Christofferson & Cook, P.C.

(57) ABSTRACT

A step shape in a planing hull for water craft and more particularly for sailboards, surfboard or PWC for increasing the lift in front of the step and decreasing it in back at high planing speed, which has dynamic lift directly behind the step when the hull is traveling at a transition speed between displacement mode and planing mode, but at high planing speed it does not have lift directly behind the step. The hull has increased speed because the lift behind the step at transition speed allows the position of the step to be moved forward and in one embodiment has cambered surface (9) in front of the step. This step does not go across the full width of the hull such that there is a continuous planing surface in front of the fins or other means, which it is desirous that they not ventilate, and fin or other means has more ventilation resistance in another embodiment.

20 Claims, 11 Drawing Sheets

SAILBOARD STEP DESIGN WITH LESS VENTILATION AND INCREASED SPEED

CROSS-REFERENCE TO RELATED APPLICATIONS

This application is a United States national-stage filing from Patent Cooperation Treaty (PCT) application PCT/US2009/057138 filed Sep. 16, 2009, which claims benefit of U.S. Provisional Applications 61/097,836 filed Sep. 17, 2008 and 61/165,472 filed Mar. 31, 2009, all of which are herein incorporated by reference.

FIELD OF THE INVENTION

The present invention generally relates to hull designs for watercraft such as sailboards, surfboards and so-called personal watercraft (PWC) and, more particularly, to a step design for a planing surface thereof.

BACKGROUND OF THE INVENTION

Many watercraft are designed to operate in a planing mode as well as in a displacement mode, particularly watercraft designed for recreational use. In a planing mode of operation, lift is derived from a downward deflection of water by the shape of the hull at relatively higher speeds than hulls operating in a displacement mode where lift is derived from the mass of water displaced by the hull. It is well-recognized that the force required to propel watercraft increases sharply with speed during displacement mode of operation and through a transition mode of operation where the watercraft speed causes the onset of planing. When planing is achieved, much of the wave drag is lost. The total drag force then decreases and increases only slightly with increased speed until reduction of the wetted surface decreases and then the wetted surface increases. Accordingly, to further reduce the wetted surface area, and drag at higher planing speeds, hulls have sometimes incorporated a step, generally formed as a substantially vertical surface following a planing surface. For a sailboard, these steps are generally near the back or stern of the board. As lift from planing increases with speed, the portion of the hull behind the step would be lifted clear of the water and was (or was assumed to be) substantially dry.

For small planing hulls such as those of sailboards, such steps and their location were a compromise of having the planing surface further forward, i.e. near the center of gravity when planing fast and a larger planing surface when the hull is starting to plane, i.e. when the board is moving slower and an attempt is being made to transition it from the displacement mode to a planing mode by exceeding a speed hereafter called the transition speed. Also, prior art steps on a sailboard hull had a flat or slightly rockered planing surface in front of the step.

From Bernoulli's theorem, since the water speed is greater at this step than it is after any expansion past the step, there is a vacuum that tends to form behind the step. Such a vacuum, of course, forms a drag force on this vertical surface in the sailboard hull or other watercraft hulls. This is why these prior art steps need to be ventilated as taught in U.S. Pat. No. 6,595,159 B2. However, it was not known how deep to make the step and there was little, if any, lift behind these prior art steps when the hull was transitioning from displacement to planing mode.

The main purpose of the steps, when there is sufficient wind or power, is to allow the hull to plane at a higher, more optimum attack angle thus reducing the wetted surface, decreasing the drag and increasing the hull speed. Generally for any planing hulls with a fixed center of gravity, the attack angle of the hull starts out above the optimum at transition speed then decreases to below the optimum as speed increases. Conversely the optimum angle is smallest at transition speed, due to some displacement lift, and then increases to 4 or 5 degrees as planing speed increases to about 30 mph where the displacement lift is essentially zero.

For sailboards, a sailboarder can change their position on the board or hull thus changing the center of gravity. However, almost all sailboarders lack the skill to achieve the optimum attack angle from transition speed to very fast planing speed on prior art sailboards with prior art steps, particularly since foot straps are provided in one location.

In many prior art steps, the step is across the whole planing surface as in the step on a flying boat, airplane pontoons and some boats. In other cases, the step may be formed by the end of a sponson. In either case, substantial drag at transition speeds is presented.

There are a number of additional problems with the prior art step.

1) At the transition speed, there is turbulence which forms behind the vertical portion of the step. This turbulence of course increases the wave drag in addition to the drag caused by the vacuum which tends to form behind a step.
2) Particularly for a step on the planing surface of a sailboard, there is a side portion of the step where the step angles back toward the rear of the board. The vortex that forms from the water coming off this section of the step can cause the surface behind the step to be wetted even when planing at higher speed. This then increases the wetted surface drag when it is desired to have this surface dry, i.e. free of contact with the water.

Ventilation of a fin as on a sailboard is when air is drawn in to the low pressure side of the fin. The resistance of a sail board fin to ventilation depends on the distance from the fin to the back of the board and the width of the planing surface to the side of the fin. In the prior art, the region behind the step is recessed deeper into the hull or board than the region next to the fin and the vortex which then forms can ventilate the planing surface back to the side of the step thus reducing the ventilation resistance of the fin.

Note: that NACA uses depth of step to denote the height of the step into the hull, see for instance NACA TN 1062 (1946), rocker is a term used in water craft, particularly in surf boards and sailboards, of slight positive $2^{nd}$ derivative and camber is a term used in wings, hydrofoils or planing surfaces of negative $2^{nd}$ derivative. The camber at the end of a planing surface either toward the rear or toward a chine is called cupping.

SUMMARY OF THE INVENTION

It is therefore an object of the present invention to provide a step for a planing surface of a watercraft which provides increased dynamic lift behind the step at or near the transition speed and is located to provide more nearly optimal angle of attack at planing speeds.

It is another object of the invention to provide a step having reduced wetted surface and vortex drag and which converts the inherently created vacuum into a forward thrust, as well as to increase effective aspect ratio of the wetted surface in front of the step as well as to resist ventilation of a fin.

It is a further object of the invention to provide a step that causes reduced variation in the optimum location of the center of gravity to maintain near-optimum angle of attack over a range of planing speeds.

In order to accomplish these and other objects of the invention, a step shape for a planing hull is provided, wherein the surface immediately in front of a step makes up only part of the beam of the planing surface and the remainder of the beam includes a planing surface, the step shape including a planing surface, a small step depth at the end region of said planing surface followed by a surface region having a contour that approximates a trajectory or wake of water which would occur directly off of said planing surface near but above the transition speed and desired attack angle and will cause water to contact a further surface region behind or on the surface region having said contour when the hull is at transition speed, but does not contact said surface region at a faster high planing speed, said further surface region being at such a depth to have dynamic planing lift on the surface behind the said small step depth when the hull is at a transition speed from a displacement mode to a planing mode and which, at higher planing speed, the main water flow from the step does not contact the said surface region behind the said step depth, said step being located in the back 40% of the hull.

In accordance with another aspect of the invention, a step shape for a planing hull is provided comprising a first planing surface with an end region adjacent to said planing surface with a positive second derivative shape on the order of 1.0 ($cm^{-1}$) to form an angle at the end of the end region which is considerably less than 90° and on the order of 20°, a second region of the hull directly behind said end region with depth into the hull surface of 5±4 mm measured from a line, which starts on the planing surface 20 cm in front of the end region and is tangent to the end region, and extending backwards up to 20 cm.

In accordance with a further aspect of the invention, a step for a planing hull is provided including a side part of the step extending back toward the end of the hull of a sailboard or watercraft, and a planing surface which abuts the side part of the step to form a butted surface, said planing surface being cupped such that the attack angle of the butted surface is increased at the side part of the step.

In accordance with a yet further aspect of the invention, a hull of a sailboard, surfboard or personal water craft is provided with at least one step, where the region near the fin or the like for which ventilation is undesirable includes a planing surface which is substantially flat in a transverse direction of the hull and a region immediately in front of said step is at a greater depth than an adjacent region that is in front of the fin or the like.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
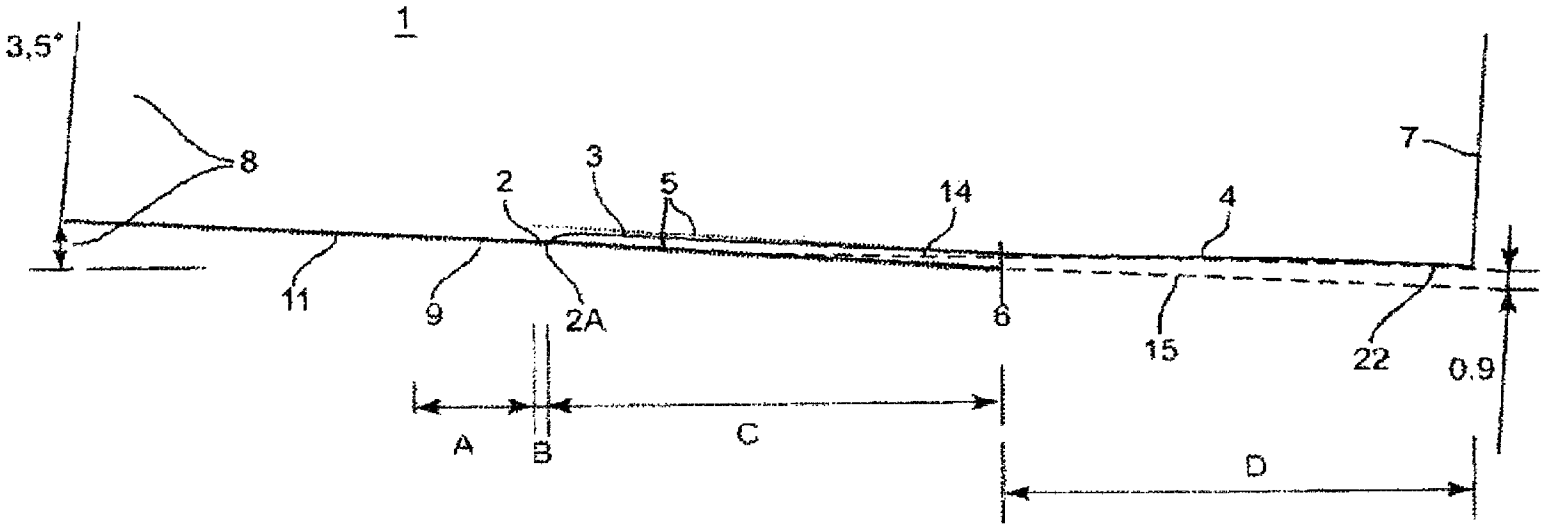
FIG. 1 is a longitudinal cross-section of the preferred embodiment of the step in accordance with the invention.

Referring now to the drawings, and more particularly to FIG. 1, a longitudinal cross-section of a preferred embodiment of the step in accordance with the invention is shown. It should be understood that while the step in accordance with the invention will be described principally in connection with a sailboard hull, the step is applicable to and will provide similar advantageous characteristics and performance improvements in connection with any other type of watercraft capable of being operated in a planing mode.

In FIG. 1, a cross-section of part of a bottom surface of a sailboard or other watercraft is shown including a preferred embodiment of a step in accordance with the invention, generally indicated by reference numeral 1 which is divided, for purposes of this discussion and conveying an understanding of the invention, into four regions, indicated by double arrows A-D. The first region, A, is located toward the front of the hull and includes planing surface 9. Following $1^{st}$ region and planing surface 9, the step 2 is where the water separates from the surface, particularly at high planing speed but also for a short distance in region C or in region D at lower planing speed or when the hull is moving at transition speed at which the rear of the hull behind step 2 remains in the water to provide lift from planing. This $2^{nd}$ region B of the step design 1 consists of a region of substantially parabolic curvature or positive second derivative of "y" with respect to "x" which is on the order of 1.0 $cm^{-1}$(a range of 0.3 to 3.0 $cm^{-1}$) where "x" is the direction along the long dimension of the hull and "y" is in the direction from the water into the hull. At the end of $2^{nd}$ region B (e.g. at location 2A) the surface has a slope on the order of 20 degrees (a range of 5° to 60°), which is far less than the 90° or vertical surface of prior art steps.

This $2^{nd}$ region B is followed by a 3rd region C of much less or negative second derivative of y with respect to x or rocker. The depth into the hull of this $3^{rd}$ region is 5±4 mm as shown by the dotted line depths 5 in FIG. 1. These depths 5 are measured from a line 11 which starts on planing surface 9 twenty centimeters in front of the step 2 and is tangent to the step 2 and extending twenty centimeters or more to the rear of the step 2. The end of the $3^{rd}$ region 3 is shown at 6. If the end of the hull 7, behind the step 2, is greater than 20 cm, then there is a $4^{th}$ region D shown at 4 whose depth measured from line 11 is less than the greater of 1.5 or $0.0015\times(\text{length})^2$ cm, where the length is the distance in cm to the end of the hull from planing surface 9 that ends in step 2. This depth is small enough to assure that at least part of the surface is wetted at transition speed while sufficient to assure that the surface is not wetted at high planing speed which is faster than the transition speed. In other embodiments, though not preferred, there can be a small vertical portion of the step.

Figure 3A:
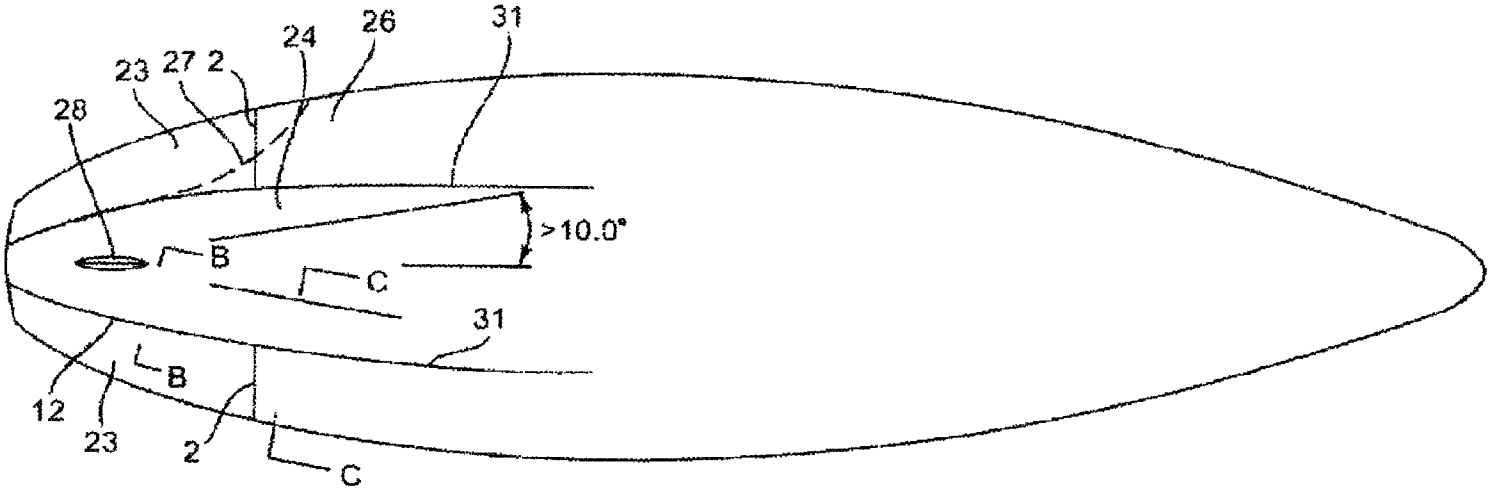
Figure 3B:
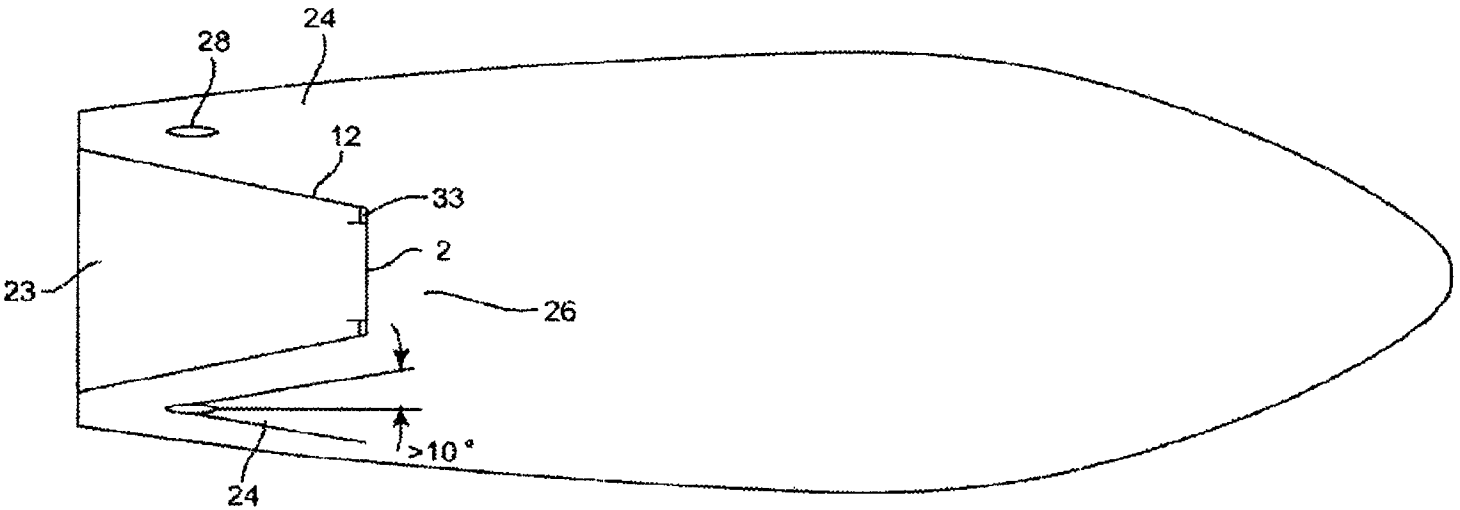

For a sailboard, the location of the step or steps of this invention is in the last 40% of the hull. For other types of vessel it could be near the center of gravity. As shown in FIGS. 3A and 3B, the steps 2 in FIG. 3A and the step 2 in FIG. 3B and the planing surface 26 form only a part of the beam of the hull at these locations. The other part of the beam of the hull in front of the fin or fins or the like which it is undesirable to ventilate, is a planing surface 24 that is smooth in the longitudinal direction of the hull over an angle of at least ±10 degrees from each fin or the like as shown in FIGS. 3A and 3B. The beam of the planing surface of the hull behind step 2, for fast planing, is reduced by the width of the steps 2 and surfaces 23 in FIG. 3A and step 2 and surface 23 in FIG. 3B. The cross-section shown in FIG. 1 is taken from 20 cm in front of step 2 in FIGS. 3A and 3B, through the step 2 and to the end of surface 23.

Also shown in FIG. 1 is an estimate of the water flow 14 off of step 2 at a transition speed of 8.5 mph. This estimate would occur when there is some ventilation of the separation regions B and C such from the side of the hull. Note that this flow 14 contacts the end of the area behind the step 2 in region D, thus providing lift behind the said step 2. If this flow is not ventilated then it would contact the surface closer to the step 2. As shown in FIG. 3B there can be vents 33 just behind at least part of the end region of planing surface 9 (e.g. step 2). This ventilation may be important when region 24 is on both sides of the step, as shown in FIG. 3B. In this step shape in accordance with the invention, the depth is small enough that the vacuum which forms without ventilation can cause a forward force when the hull is at an optimum attack angle, instead of the large drag of a prior art step even if ventilated. That is, if the contact point of water transition flow without ventilation is at a more negative "y" position than the step 2, then there is net forward vacuum force in the "x" direction. This can be seen in FIG. 1, where flow 14 contacts region D near where point 4 is shown, which is below or more negative "y" than the water separation point at step 2 due to the angle of attack shown at 8 of FIG. 1.

Also shown in FIG. 1 is an estimate of the water flow 15 at a high planing speed of 14 mph. This flow clears the end of the $4^{th}$ region, D, 40 cm behind the step by 0.9 cm. Therefore, at high planing speed, water flow 15 is ventilated from the back as well as any ventilation from the side. Thus, in this high speed planing regime, flow 15 does not provide lift behind the step 2. This is verified by the (Series 2) data in FIG. 5 which shows the same high speed drag (as Series 1), but a 25% reduction in drag at the transition speed due to the lift and any forward vacuum force behind the step 2, which occurs from water flow 14 at transition speed.

Figure 6:
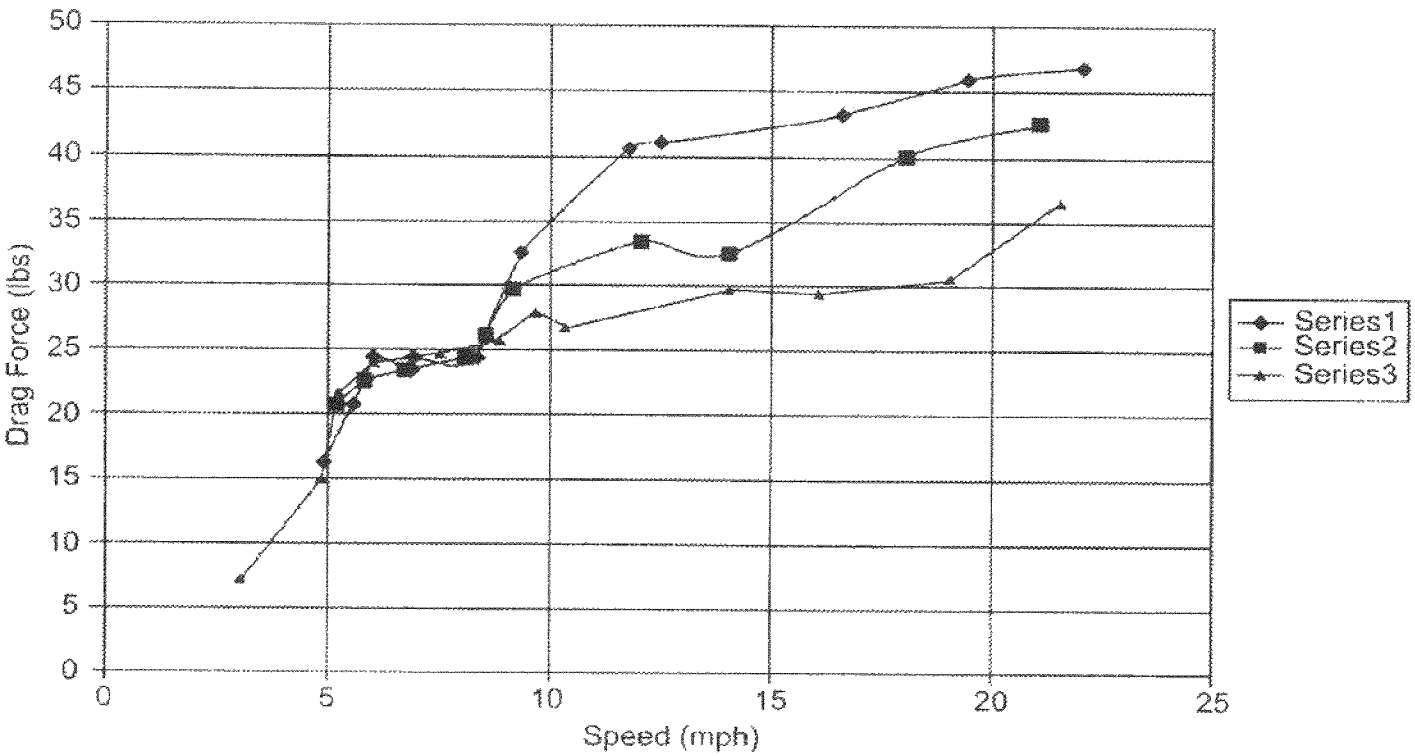
FIG. 6 is a similar graph of drag force as a function of speed comparing the invention having camber or cupping in front of the step to a hull with no step and a hull with a step principally recessed into the bottom of the hull or board.

If desired, the planing surface 9, just in front of step 2, may be cupped, here by 2 degrees. (The term cupped or cupping as used herein is intended to connote a slight bending or downward curving, along the direction of water flow, of the surface in a direction toward the water for purpose of adjusting the direction of water flow.) It has been shown that this cupping of surface 9 along with cupping 22, at the end of region D of the step design 1, and contact with water in region D and/or C can give the same lift at transition speed as if there were no step 2. This substantially equal lift has been verified by data for drag on the 98 cm wide sailboard both with this preferred step design 1 and without any steps, as shown in FIG. 6. In addition, cupping 9 increases the lift in front of the step which is desired when planing at high speed.

From the theory and equations in Payne, Peter R.; J. Hydronautics, Vol. 8, no. 2, (1974) appendix A, the optimum camber, cupping 9 or hook angle "δ" is about 4-7 degrees depending on the planing attack angle "$\tau_o$" of the board and the wetted length "$l_m$" in front of the step. Larger optimum camber angles "δ" are appropriate for fast speeds that produce smaller attack angles "$\tau_o$". A sailboard was tested with this optimum cupping or camber angle 9 and was consistently 15% to 20% faster than a smaller board, even though, for the wind and wave conditions of this test, it would be expected the small board to have been faster (see also FIG. 7 which will be discussed below). (In conditions of high wind and high waves, smaller boards which plane at a more optimum planing angle are generally faster than larger boards which plane at a less optimum angle. The data show that in this case, the larger board is not only planing at a more nearly optimum angle but the cupping 9, larger width and aspect ratio in front of step 2 is providing a higher lift to drag ratio. Thus, the preferred embodiment of the step is allowing the board with the larger width to be considerably faster than a smaller board even in conditions which favor the smaller board.) U.S. Pat. No. 4,924,792 to Sapp and Payne and U.S. Published Patent application 208/0210150A1 also teach the use of a cup and hook angle in front of the step.

Thus not only is it preferred that this surface 9 is cambered/cupped, the optimum "δ" angle can be estimated as well as the cup depth at the step 2. From the above theory of Payne for the lift and drag of a cambered surface "δ" is given by:

$$\delta=-4C_l\tau_o+\{(4C_l\tau_o)^2+200C_l\}^{1/2} \quad (1)$$

where "$C_l$"=$l_m$/(nb), where "b" is the hull width at the step.

Therefore, the smaller $\tau_o$ and the larger $l_m$ of a particular design, the larger δ should be and will generally be between 4° and 7°.

By assuming the water flow off of the step is along line 11 at step 2 and the depth above line 11 at the end of the hull is <0.0015×(length)$^2$, where the depth below line 11 and the length from the step to the end are in centimeters, the optimum cup depth at the step 2 is given by;

$$y_2<y_1=\{20\times0.0015\times(\text{length})^2\}/(20+\text{length}) \quad (2)$$

or $$y_2\sim2/3y_1$$

For a step 40-45 cm from the end of the board this gives:

$$y_2\sim0.6\text{ cm or }<0.9\text{ cm.}$$

Figure 2:
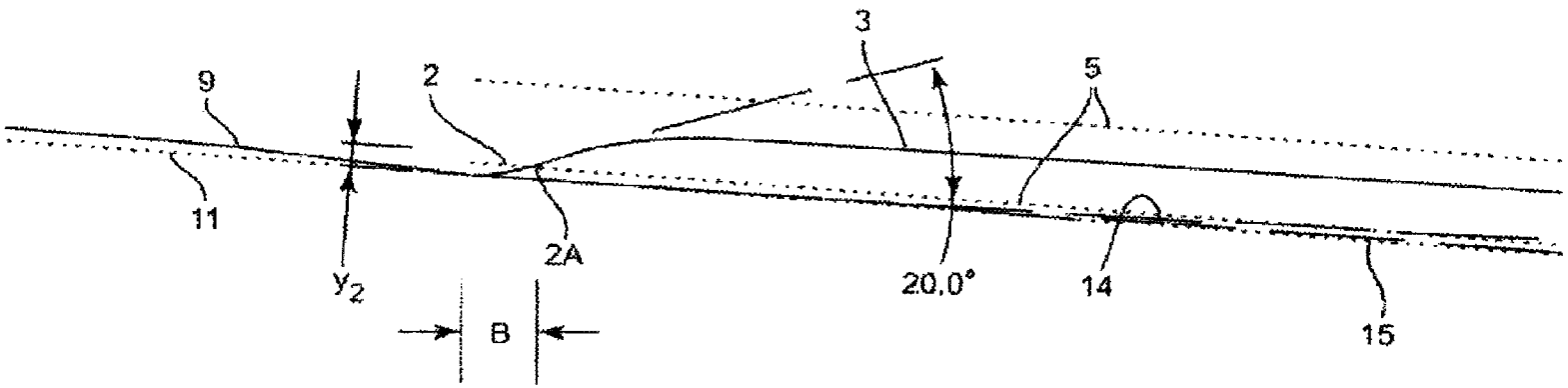
FIG. 2 is an enlarged view of the region near the step of FIG. 1, FIGS. 3A and 35 are bottom views of alternative embodiments of a sailboard hull incorporating the step in accordance with the invention.

It should be noted that FIGS. 1 and 2 depict a cup depth $y_2$ of 2 mm. If $y_2$ is 6 mm then the top of $y_2$ will be, coincidentally, roughly the same height as the surface 3 or region C even though, as defined in equation (2), above, $y_1$ and $y_2$ are a function of length of the hull or board behind the step 2. The bottom of $y_2$ is, of course, at line 11.

This camber in front of the steps increases the dynamic water pressure not only on surface 26 in FIG. 3A directly in front of the steps but also on the surface 24 in FIG. 3A between (or on the sides of surface 26 in FIG. 3B). Thus when the time average of the wetted length (the instantaneous wetted length will be constantly changing due to wave action and the like) in front of the step 2 becomes small at high planing speed, this length times the width of the hull in front of the step 2 effectively becomes a high aspect ratio lift area with an effective attack angle which is larger than $\tau_o$ of the board due to the cup 9 and hook angle δ. Therefore the effective width and lift/drag ratio of the board is relatively increased. Thus, as a result, the speed of the board increases for a given $\tau_o$. Data for a 66 cm wide board showed an increase of speed of 15% to 20%, while FIG. 6, series 3 data, shows the reduced drag for a 98 cm wide board. In these data δ was ~5° and the cup depth $y_2$ at the step was 6 mm.

Referring now to FIG. 2, which is an enlarged view of the area near the step 2 and the $2^{nd}$ region B, the curvature of region 2 of positive second derivative, on the order of 1.0 $cm^{-1}$ or a curvature radius on the order of 1 cm (although the shape is approximately parabolic, as noted above) is shown.

Note that this depiction may be larger than full scale. Thus this curvature of the surface would follow the trajectory or wake of water flow below the transition speed or roughly 4 mph and prevents turbulence at transition speed. The shape behind this small step also approximates a trajectory of wake of water which occurs directly off of the planing surface when the hull has a speed near but above the transition speed at a desired attack angle. This, together with the small depth of the step, produces low drag by avoiding wave drag and reducing or reversing the vacuum drag at transition speed. That is, at displacement speeds the hull shape near location 3 is approximately complementary to the trajectory of water behind the small step and thus presents little drag which is much reduced as compared to a conventional more vertical surface behind the step and at speeds near but above the transition speed and at the desired angle of attack, the water trajectory would follow dashed line 14 in FIGS. 1 and 2 and reconnect with the hull at a very shallow angle again producing little drag while generating some displacement and/or dynamic planing lift to assist in achieving the desired angle of attack.

At higher planing speed the main water flow from the step 2 does not contact the surface region behind the step in region B. Since different watercraft and different total weight could have different step depths "a small step depth" as used herein means a step depth smaller than that where the ventilated flow at 2 mph above the transition speed, for an attack angle, $\tau_o$, of 3.5°, reconnects with the hull is below the "y" position of the step 2. That is, if the step is deeper, the flow will curve upwardly to a greater degree and the y depth of the point where the flow reconnection occurs will be above the y depth of the step 2.

Referring now to FIG. 3A, the surface region behind the step is labeled 23 while the region near, in front and in back of the fin is planing surface 24. The boundary between these two surfaces is line 12. Either surface 23 must be recessed into the board relative to surface 24 or, preferably, surface 24 has cupping 19 (FIGS. 4A and 4B) to both prevent the water, at high planing speed, from flowing out to surface 23 and/or to prevent vortex flow off of surface 24 at line 12 causing water flow onto surface 23 and causing it to be wetted. Much the same effects are provided in the single step embodiment of FIG. 3B in which the planing surface 24 and the step surrounds surface 23 on three sides.

Figure 4A:
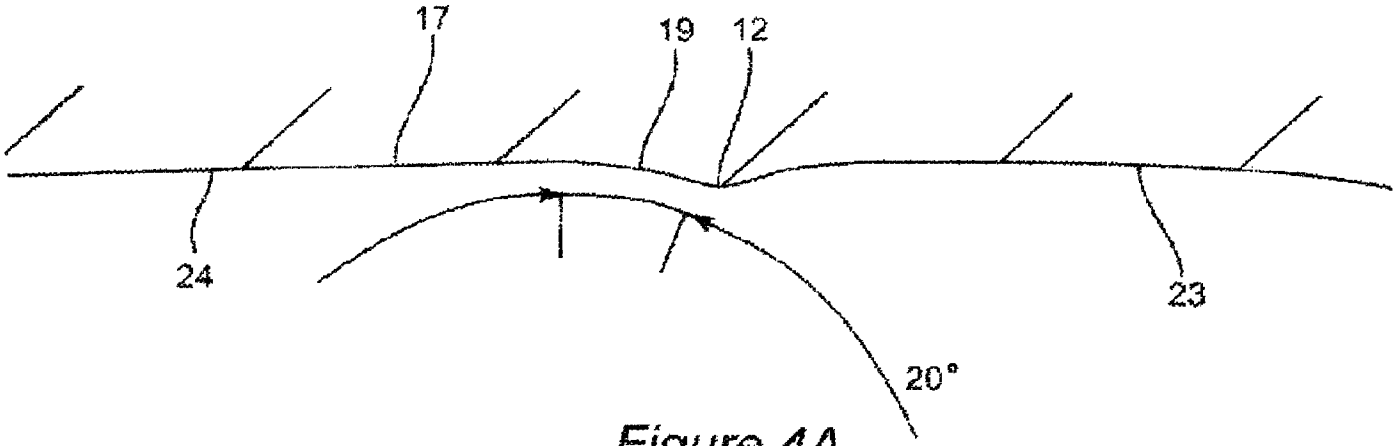
FIGS. 4A and 4B illustrate sections of the sides of the step in accordance with the invention.
Figure 4B:
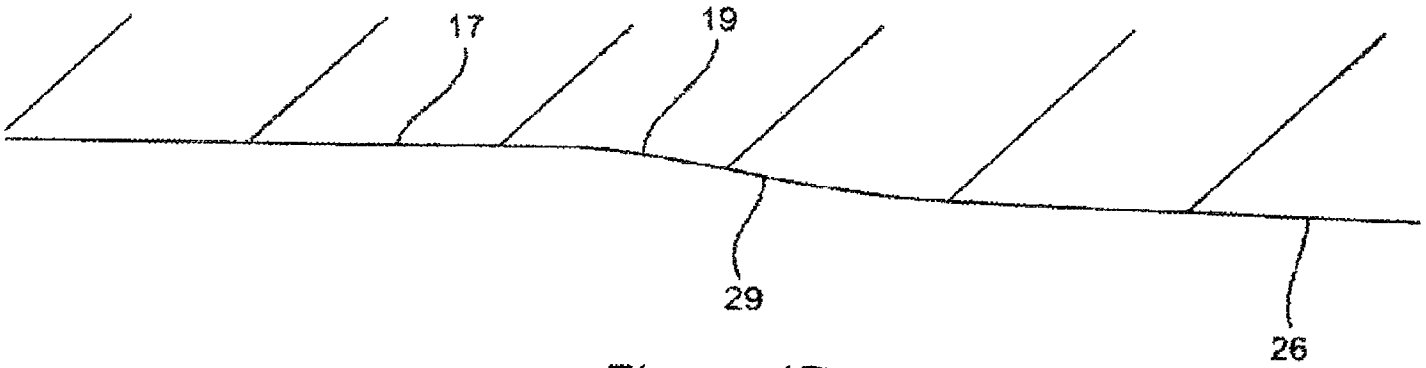

FIGS. 3A, 3B, 4A and 4B show the uses of this step design on the bottom view of a sailboard with the added feature that the regions 23 behind the steps and the region 24 near the fin are at roughly the same average depth except for a cusp and cup 19 (FIG. 4A) between the regions 23 and 24 to decease the vortex flow onto regions 23. FIG. 3A shows section BB of the side portion of the step design 1, which is shown in FIG. 4A. FIG. 3A also shows section CC of the side portion in front of steps 2, which for one embodiment is shown in FIG. 4B. Similar profiles, (but reversed left-to-right) would preferably be employed in the embodiment of FIG. 3B, The fact that regions 23 are not significantly recessed into the board near the rear portion thereof but approach the depth of planing surface 24 at the rear of the board increases the water pressure near the fin and thus increases the ventilation resistance of the fin. That is, at and near transition speeds, there is little vortex flow at the side of the step because there is water contacting surfaces 24 and 23 on opposite sides of the step and both surfaces are at essentially the same depth. Instead, the planing regions in front of steps 2 are set deeper into the water than the adjacent part of region 24. This difference in depth is shown by line 31 in FIG. 3A and in the cross-section of FIG. 4B. In addition, it is desired that the attack angle of the regions 26 in front of steps 2 and cupping 9, be larger than the adjacent the adjacent area of region 24 by about 2 degrees or a range, not including the cupping described above, of 1 to 3 degrees relative to surface 24. (That is, the angle of attack of the planing surface 9 should be increased by 1° to 3°. This allows the board attack angle at high speed planing to be larger both due to the increased attack angle and the increase in the pressure at the center of the board near regions 26.) For a surf board or sailboard, it is desirable that the central fin not be ventilated, while for a PWC or jet boat it is the jet water intake that should not be ventilated.

Step 2 need not be perpendicular to the water flow. As shown in FIG. 3A, line 27 illustrates a step which may be angled over its full length. In this case line 31 and/or transition 29 can be considered part of cupping 9 or 19. That is, the final resultant surface or overall step shape or step design 1 including a step 2 in accordance with the invention is a surface that includes a set of features that are all completely consistent with improvements, in performance such as reduction of drag at displacement, transition and fast planing speed, production of net forward thrust from a vacuum which is inherent in the absence of step ventilation at transition speeds, stabilization of angle of attack and avoidance of "porpoiseing", increase of lift at transition and planing speeds, limitation of shift of center of pressure over displacement to planing speeds, reduction of wave drag and decrease of wetted area due to wetting of surfaces by vortices, increase of fin ventilation resistance and other meritorious effects discussed herein which have very different requirements over a wide rage of conditions and it is thus immaterial to evaluate the particular contributions of each feature to each particular effect. By the same token, those skilled in the art will be enabled, in view of this disclosure, to produce emphasis of one or more of these desirable effects for particular conditions with little, if any, compromise of other desirable effects or performance under other conditions. Conversely, regions of the board other than regions containing features of the invention discussed above can be of any shape consistent with known sailboard features and designs and are unimportant to the practice of the invention.

In contrast with this unique combination of consistently beneficial features, U.S. Design Pat. Des 258,516 may appear somewhat similar to the invention but the surface region behind the step is not recessed nor is there a cupping adjacent this region to keep water off of this region at higher planing speeds. U.S. Pat. No. 5,191,853 and U.S. Pat. No. 5,588,389 are perhaps the closest description in prior art of the surface region behind the step. However, in '853 and '389 the planing area behind the step is designed to, in '853, "stay in the water and provide lift" and in '389 must be in the water because of the location of the step and center of gravity. Both also have vertical steps (step 4 in '583 and step 23 and 102 in '389) giving a step depth which is much larger than that of the invention. Mote importantly, both teach steps extending across the whole beam of the hull. That is, they do not have a smooth planing surface for a substantial distance in front of a fin or other desirably non-ventilated structure.

FIG. 4A shows the cross section BB, roughly perpendicular to the side part of the step, oriented with the hull up and water down. Of particular interest in this Figure is the cupping 19. It is preferred that change in angle from the large part of the adjacent planing surface 17 (part of surface 24) to the end of this cupping 19 be about 5 to 30 degrees (as distinct from the cupping 9 and its optimum angle of 4° to 7° in the direction of water flow discussed above). This is so that the attack angle of the water flowing off of the side of the step at location 12 (e.g. approximately longitudinal of the board) from surface 24 is increased from that which would flow off of surface 17 at the side of the planing surface. Surface 17 is shown with a dead rise angle of 2 degrees. The increased attack angle allows the surface 23 to be dewet at the higher planing speeds. Region 24 including 17 and 19 and region 23 can be and preferably are slightly concave regions. These regions are connected by a surface curvature which can be on the order of 1 cm radius, forming the step.

At the higher planing speeds this cup 19 reduces the vortex of the water coming off of side step 12, thus reducing the water flow onto the area 23 behind the step 2. Such water flow is, of course, undesirable for high planing speed, since this will add both drag and lift at the back of the board and thus reduce the planing angle below the optimum.

Further, as alluded to above, this cup angle can be larger for side portions of the step which are more aligned with the length of the hull or where the area behind step 2 is wide. That is, if the water flow is at a very obtuse angle to cross section BB then cupping near "12" in FIG. 4A will be only, a small angle of cupping for the water flow. If the step 2 is wide, then the flow coming off of the side step 12 should get more of a downward direction to avoid the vortex effect from bringing the flow back up to the surfaces behind step 2. The length of this cupping, as stated above, should be short (here shown as 2.5 cm) so that it does not appreciably increase the lift of surfaces 17 and 19.

Referring now to FIG. 4B, transition 29 allows region 26 to be deeper into the water than region 24. This transition may be sharp as in a vertical step or gentle with a maximum angle of 10 to 15 degrees as shown. Transition 29 should be blended into step 2 and cupping 19 behind the step 2. The depth difference between regions 26 and 24 can be on the order of 0.6 cm or range of 0.2 to 1.8 cm near the step and blended to zero further in front, (e.g. at the front end of line 31). Transition 29 and line 31 may be straight or curved as shown in FIG. 3A.

The back planing surfaces 23 shown in FIG. 3A, which is outside of the of the planing region 24 near and in front of the fin 28, can have a positive rocker on the order of a 15 meter (1500 cm) radius or a positive second derivative of $0.6\times10^{-3}$ $cm^{-1}$ or range of $0.2–2\times10^{-3}$ $cm^{-1}$. In addition, rounded step 2, cupping 9 and cupping 22 at the end of the board, produce lift at transition speed but dewet the surface 23 behind the step(s) 2 at faster planing speeds. If there is cupping 22 at the end on the outside of the board, then it is preferred that the top surface of the hull above cupping 22 be cambered at least as much as the cupping 22 so that this part of the hull terminate in a manner similar to the back of a wing and the cupping does not add any thickness.

The step height consists of a downward curved section (cup 9 of FIG. 1) of about 10 cm length with a maximum angle on the order of 4 degrees. This is followed by a smooth upward curve with a radius on the order of 1 cm or range of 0.3 to 4 cm. These steps, rocker and cups allow the sailboard to be sailed at an optimum attack angle (3° to 5°) from transitional speeds to speeds greater than 20 mph. Yet the rocker, steps and cups are easy to fabricate into the bottom planing surface of the board. Again there should be an increased attack angle at the intersection of the planing surface region 24 and the region 23. Surface region 24 is in the center in FIG. 3A but in a two fin board there can be a rockered, stepped and cupped region in the center between the two fins as shown in FIG. 3B. Since the steps 2 are small, these steps can be constructed from an additional piece of Divinycell under the fiberglass skin.

The board's bottom can be essentially flat near the fin, except for the increased attack angle the intersection between regions 23 and 24. In this way the board and fin will have more resistance to ventilation of the fin at transition speeds, while the increased bottom depths near the front of the step will increase the attack angle of the sailboard closer to optimum when the board is planing fast.

Figure 5:
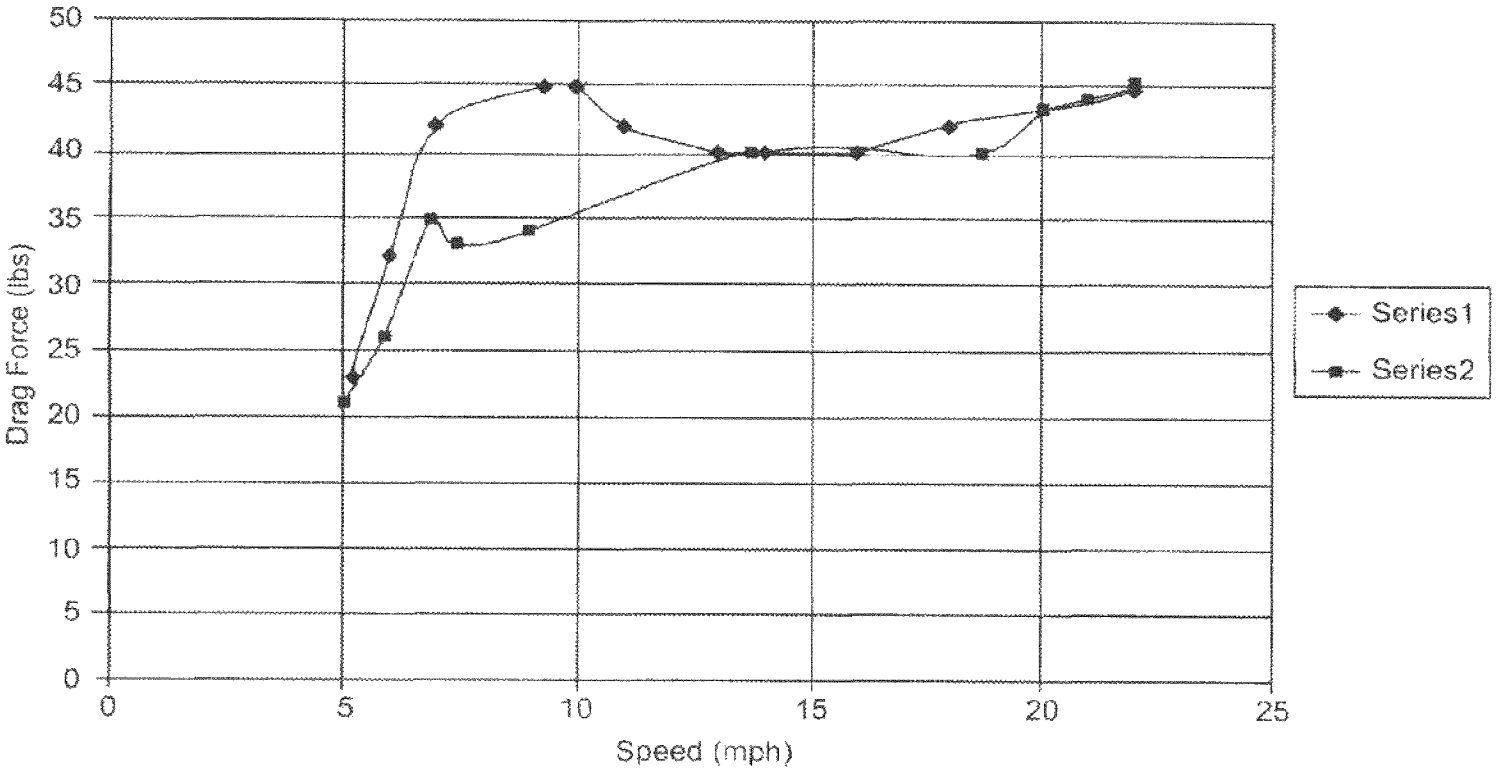
FIG. 5 is a graph of drag force as a function of speed comparing the invention to a conventional vented step.

FIG. 5 shows drag data of a sailboard obtained with 170 pound person on a 76 cm wide board. The board was equipped with a 40 cm True Ames SB weed fin and was being towed by a boat with the person adjusting his position to obtain the lowest drag for a given speed. However, the person did not move behind the sailing position for a sailboarder in the foot straps so as to simulate only the position for the center of gravity of a sailboard and sailboarder of 200 pounds total. The series 1 data is for a normal prior art ventilated step design 35 cm from the end of the board of an average width of 9 cm and an average depth of 2 cm on each side of the back part of the board. This data show that it took 40.5 pounds of force and a speed of 10 mph to get the board to plane and 36 pounds of force at a speed of 14-16 mph which was the minimum force to maintain planing for this series.

Series 2 was for one embodiment of a step design in accordance with the invention, again the step was 35 cm long, an average of 9 cm wide and having a depth of 0.3 cm at a location 5 cm behind the step 2 and a depth of about 0.6-0.08 cm at the end of the regions 3 and 4. For this step, the board transitioned to planing at 7.4 mph and only 29.7 pounds of force were required to maintain planing speed. Moreover, during high speed planing at 14 to 22 mph the force was the same or possibly slightly less.

These series 1 and 2 data show that the step in accordance with the invention has lift behind the step to get the board to plane with both less drag force and lower board transition speed. Yet at high speed it reduced the planing area behind the step(s) as effectively as the theoretical operation of a normal (prior art) step including a vertical surface but which cannot achieve such low drag because of wave drag due to vortices and other effects such as wetting of theoretically dry surfaces. Note that there was a 20 to 25% reduction in the drag force at transition speed achieved by the invention even though the step area represents only about 10% of the board planing area. This could be due to the rocker in this board or the wave and turbulence drag behind the normal prior art step with a vertical 2 cm depth.

As briefly discussed above, FIG. 6 shows drag data for no steps as shown in series 1 and a step of the present invention with a camber/cup of about 2 mm shown in series 2. This drag data was obtained with 170 pound person on a 98 cm wide sailboard, which had two 39 cm True Ames shallow weed fins. Again, while being pulled by a boat, the person adjusted the board angle by moving where a sailor would move to achieve optimum angle of attack and minimum drag at various speeds.

In can be readily seen that this 98 cm sailboard loses its wave drag at 6.0 mph due to its winglets (see US 2003/0003825 A1) not discussed here. All data series show essentially the same drag, within experimental error; from 6-8 mph. Starting at about 9 mph of board speed the series 2 & 3 data show less drag. At 15 mph the series 2 drag is about 20% less than the series 1 data with no step.

Series 3 is for the step embodiment at 45 cm from the end of the board with a camber/cup 9 depth of 6 mm. These data show 30% less drag for board speeds of 12-19 mph from that of no step and up to 20-25% less than series 2 data. This is because the increased lift in front of the step, due to the increased camber 9, allows the board to sail at a more optimum attack angle, which produces a greater lift to drag ratio. The increase in drag in the series 3 data from 10 to 19 mph is less than the increase of drag on the two fins between these speeds, while above 19 mph the major increase may be due to a decrease in attack angle τ or wake from the boat.

Figure 7:
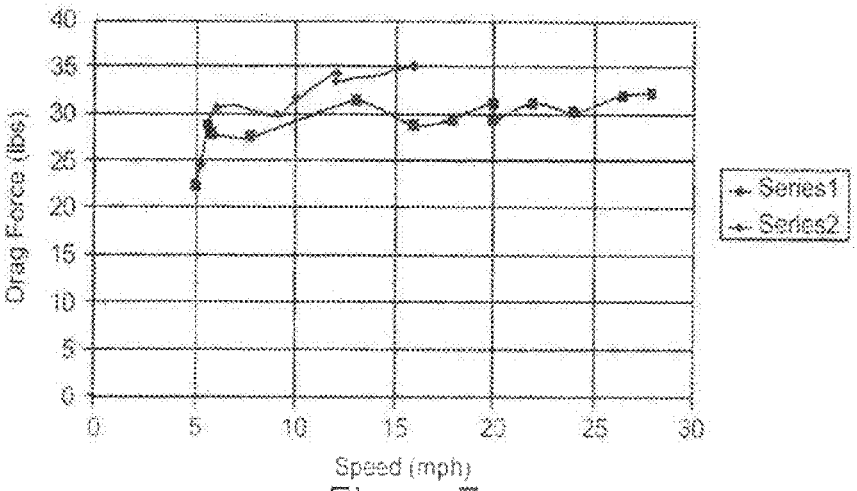
FIG. 7 is a similar graph of drag force as a function of speed comparing a 66 cm wide hull in accordance with the invention to a 66 cm wide hull having a conventional vented step.

FIG. 7 shows drag data for the 66 cm wide sailboard with a 35 cm Select Eagle fin. Series 1 data is for this board with prior art steps similar to those on an "F2 Slalom" sailboard with an average distance from the back of the board of roughly 30 cm. Series 2 data is for an embodiment of this invention with a cup 9 depth of 6 mm made from two layers of 3 mm Divinycell under the fiber glass skin, which were 45 cm from the end of the board. The series 2 data again show less drag at the transition speed even though the step is further from the end of the board and allows the end of the board to be wetted at transition speed. More importantly, above 13 mph board speed, where the surface behind the step dewets, the drag is almost flat (e.g. nearly constant) to the top speed tested, of 28 mph. This is due to both the camber in front of the step and the step location.

Figure 8:
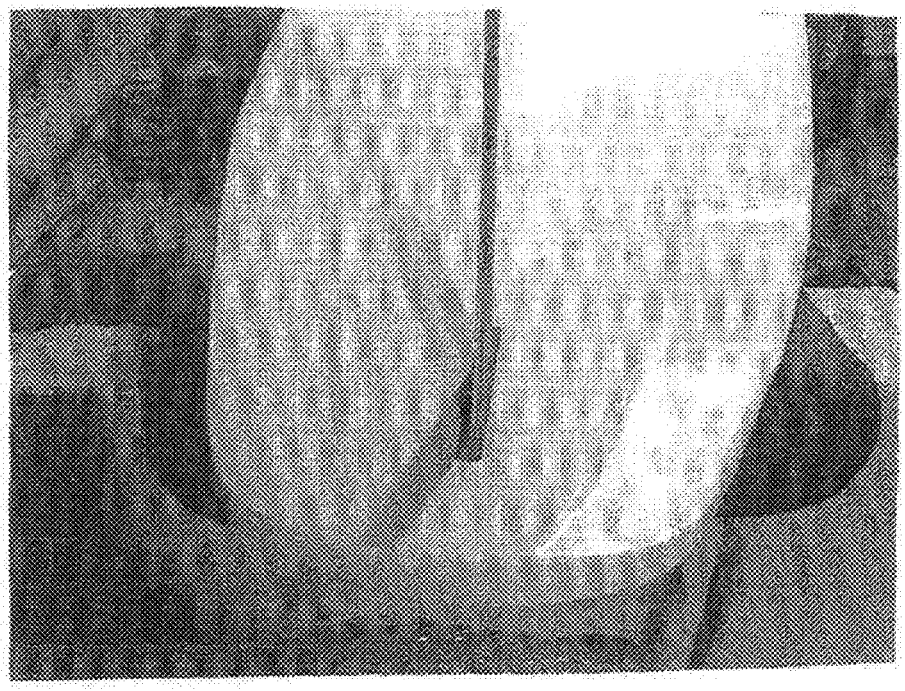
FIGS. 8 and 9 are photographs of the preferred embodiment of the invention applied to a 66 cm wide sailboard.
Figure 9:
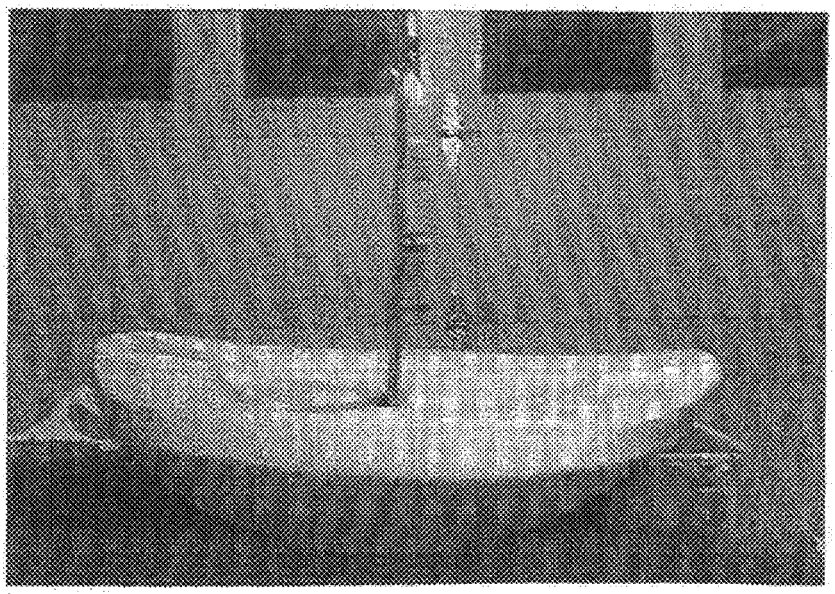

FIGS. 8 and 9 show pictures of this 66 cm wide sailboard with the preferred embodiment, including three (e.g. multiple) slightly concave regions in the transverse direction near the fin. Here the small depth of the steps can be seen and regions 23, particularly at the rear portions thereof have essentially no recess into the board.

Figure 10:
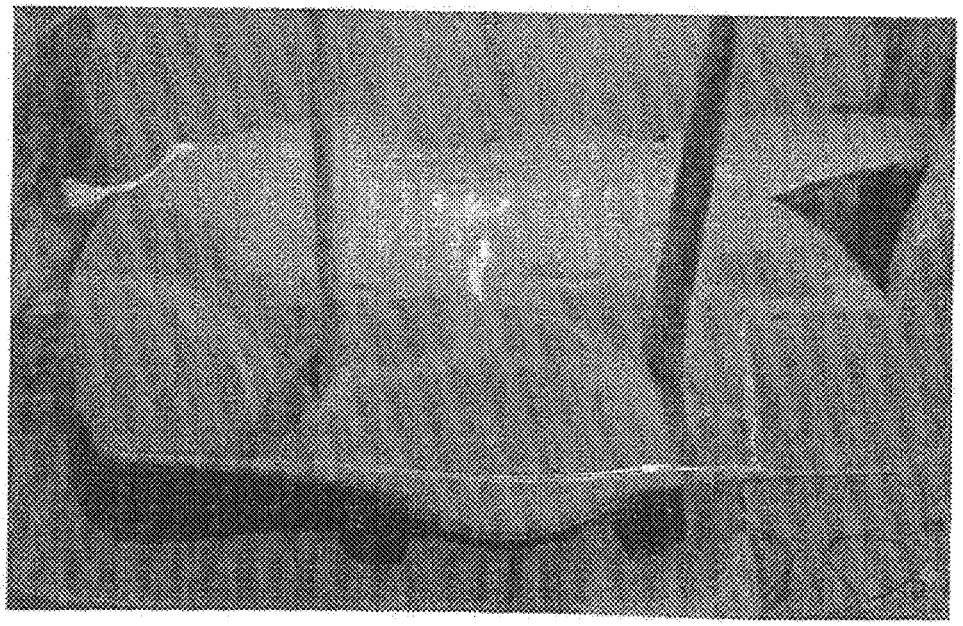
FIGS. 10 and 11 are photographs of the preferred embodiment of the invention applied to a 98 cm wide sailboard.
Figure 11:
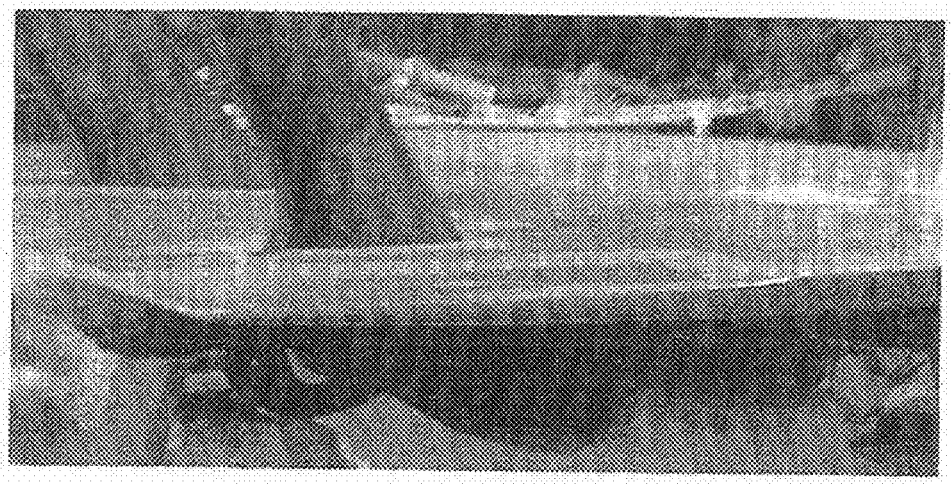

FIGS. 10 and 11 show pictures of a 98 cm wide board with two find, as tested for series 2 in FIG. 6. This board has one slightly concave region and the region 23 is recessed into the board less than 5 mm. For the series 3, the depth of step, camber 9 and the region located 9 cm or less behind the step 2 were increased by up to 4 mm in the negative "y" direction over that shown in FIGS. 10 and 11.

Those skilled in the art will appreciate that two or more applications of the step in accordance with the invention can be used in a direction longitudinally of the hull in accordance with the invention. It should be appreciated that the step in accordance with the invention can be used with known hydrofoils nearer the front or middle of the hull to better maintain an optimum planing angle at even faster planing speeds.

In view of the foregoing, it is readily seen that the step and related bottom surface features associated with and collectively referred to as a step in accordance with the invention provides a step for a planing hull, said step having a shape that includes a planing surface, preferably cambered/cupped, which ends in a small step depth followed by a surface region having a contour that approximates a trajectory or wake of water which would occur directly off of said planing area and when the hull has a speed and desired attack angle through the water at a speed between the transition speed (e.g. transitioning from a displacement mode to a planing mode) and high planing speed, which trajectory will contact the surface region behind the step when the hull is at transition speed, but does not contact said surface region at the faster high planing speed. The said step surface region being at such a depth to have dynamic planing lift on the said surface behind the said small step depth when the said hull is at a transition speed from a displacement mode to a planing mode.

In this invention the step is confined to only part of the beam of the planing surface in front of the step and the beam of the planing surface of the hull behind the step, for high planning speed or fast planing, is reduced by the width of the steps. The other part of the bottom hull surface is a continuous planing surface to the fin or other non ventilated means between the steps or on the sides of the step. Since the design of this step in this invention may not appear to be a step or to be recognized as such in view of known, vertical surface transition step designs, to one who is not skilled in the art of hydrodynamics, the step is hereby defined as that point at high planing speed where the water flow disconnects from the hull surface but at which point there is planing lift behind said point at slower speeds.

In this invention, the step and the trailing surface consists of a first planing surface, $2^{nd}$ region of positive second derivative of "y" with respect to "x", where "y" is a distance from a horizontal plane into the hull and "x" is a longitudinal distance along the plane, on the order of 1.0 ($cm^{-1}$) (a range of about 0.3 to 3 $cm^{-1}$), i.e. positive rocker or negative camber, directly followed by a $3^{rd}$ region of much less or negative second derivative or rocker. The angle at the end of this $2^{nd}$ region should only be on the order of 20 degrees (a range of about 5 to 60) from the horizontal as opposed to the 90 degrees of the prior art. That is, the angle at the end of the $2^{nd}$ section should be considerably less then 90°.

The integration of the $2^{nd}$ derivative shape across this $2^{nd}$ region gives the angle at the end i.e. the angle on the order of 0.35 radians or 20 degrees. A second integration gives the depth, into the board at the end of this $2^{nd}$ region 2A.

The attack angle of the end of the $3^{rd}$ section should be on the order of zero degrees of attack angle. If desired or preferred, the last or $4^{th}$ section can then have a region of positive camber, negative second derivative of "y" with respect to "x", to an attack angle that can, if desired, approximate or exceed the average attack angle of line 11 of FIGS. 1 and 2.

The general shape of most of the $3^{rd}$ and $4^{th}$ regions should be close to that which the water would take if there were not a surface behind the step, or only a vertical surface as in known step designs but no further surface to the rear of the vertical surface, for a hull speed between that of the transition speed and the high planing speed. The final height of the last section should be such that it is dry or unwetted, i.e. it is not in the main water flow, at the desired high planing speed. This can be predicted by the standard equations for the wake behind a planing surface given, for example, in "Hydrofoil Handbook" Vol. II, Hydrodynamics Characteristics, of Components, chapter 6, Bath Iron Works Corp., Gibbs and Cox, Inc. New York, N.Y. (1954), or "Hydrodynamics of High-Speed Marine Vehicles" by O. D. Faltinsen, section 6.2, pp. 344-358, Cambridge Univ. Press. It is preferred that the region just in front of the defined step point has added camber/cupping.

Thus at transition speed much of the entire region behind the step is in the flow of water and the last camber region has lift, as it turns the water flow downward and the dynamic drag of such a region is very small while at the desired high planing speed, except for possible spray, this region is completely out of the water, thus increasing the attack angle of the hull and reducing the wetted area.

The lift in this $4^{th}$ region behind the step point will compensate the lift near the front of the board near the transition speed when the rear of this region is wetted, while the lack of lift in this area at high planing speed will compensate for the front of the wetted planing surface moving back. Thus the optimum location of the sailboarder will be confined to a smaller region near or at the foot straps. Since the region of the step can now be considerably in front of the end of the board's tail, this invention will stabilize the porpoiseing effect.

In accordance with the invention, porpoiseing is limited by the fact that the step may now be further forward thus making the width of the front part of the wetted planing surface considerably wider than that at the rear at high planing speed. Thus for a given attack angle where porpoiseing occurs, the planing surface is longer. During a heave motion of porpoiseing, this reduces the force near the front of the planing surfaces in a nonlinear amount, while any contact of the end region with the water will increase the force in the rear, in a nonlinear amount. This increased length and these nonlinear effects are what decrease the porpoiseing and tail walking. The tail walking is limited by the third region behind the step point coming in contact with the water flow when the optimum attack angle is sufficiently exceeded.

The step in accordance with the invention essentially eliminates the need for step ventilation other than that which will occur from the back of the board at higher planing speeds due to its small depth. If for some applications it is desired to ventilate this step from above or from the side, the region between the $2^{nd}$ depth region and $3^{rd}$ region can be modified in the normal way to add a ventilation region. However, as much as possible of this $3^{rd}$ region should be preserved, as shown in FIG. 3B, to maintain a smooth water flow pattern at transition speeds as described above and as shown in the drawings. Thus the longitudinal, i.e. the direction of the water, length of the ventilation should be −1 cm or else the width of ventilation should be small relative to the step width.

This step design preferably has no vertical surface, except for a small region if further ventilation is desired, thus it produces less drag. Indeed the Bernoulli vacuum results in a forward force rather than a drag force when there is no additional ventilation and when the hull is in at the optimum planing attack angle such that there are no regions with negative attack angles, except for a few centimeters. Irregularities in the water flow such as vortices, however, may still present significant lift and drag unless mitigated or eliminated by cupping of the planing surface at the edge or side of the step.

That is, in order to reduce the vortex from a side section and its drag or lift on the surface behind the step, the planing surface just before any side section of the step should be cupped or cusped like a chine flare or recurvature. This cusp or cupping will give the water some increased downward motion, as it passes off of this edge. This cusp or cupping will reduce the vortices and reduce the amount of water going to the surface behind the step, thus reducing the lift (which may alter angle of attack) and drag during high speed planing from the surface behind the step, which would be caused by too much vortex flow directing water flow up onto the last region. This cupping length is only a few centimeters long so that it does not appreciably increase the lift of the said planing surface before the side step.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A step shape for a planing hull, wherein a surface immediately in front of said step makes up only part of a beam or width of a planing surface and a remainder of the beam or width of said planing surface includes a planing surface, said step shape including a portion of said planing surface, a step depth at the end region of said portion of said planing surface followed by a surface region having a contour that approximates a trajectory or wake of water which would occur directly off of said portion of said planing surface near but above a transition speed and desired attack angle, said surface region being at a depth that will cause water to contact a further surface region behind said surface region having said contour when the hull is at transition speed from a displacement mode to a planing mode, but does not contact said surface region at a planing speed faster than said transition speed, said further surface region being at such a depth to have dynamic planing lift on the said surface behind or on the said step depth when the said hull is at a transition speed from a displacement mode to a planing mode and which, at increased planing speed, principal water flow from the said step does not contact the said surface region behind the said step depth, said step being located in the back 40% of the said hull, said step further comprising a first planing surface with an end region adjacent to said planing surface with a positive second derivative shape of 0.3 to 3.0 ($cm^{-1}$) to form an angle at the end of said end region which is less than 90°, a second region of the hull directly behind said end region with depth into the hull surface of 5±4 mm measured from a line, which starts on the said planing surface 20cm in front of said end region and is tangent to the said end region, and extending backwards up to 20 cm.

2. The step as recited in claim 1, further including a side part of the said step extending back toward the rear of the hull, and a planing surface which abuts said side part of said step is cupped such that an attack angle of an intersection of said side part of the step and said planing surface is increased.

3. The step as recited in claim 2, wherein the said increase in attack angle perpendicular to said side part of the step is increased by 5° to 30°.

4. A step as recited in claim 1, wherein a region near a fin or other means for which ventilation is undesirable includes a portion of said planing surface which is substantially flat in a transverse direction except for cupping of the side step and concave or multiple concave shaping, and the region immediately in front of the said step is at a greater depth than the adjacent region that is in front of the fin or other said means.

5. A step shape for a planing hull comprising a first planing surface with an end region adjacent to said planing surface with a positive second derivative shape of 0.3 to 3.0 ($cm^{-1}$) to form an angle at the end of said end region which is less than 90°, a second region of the hull directly behind said end region with depth into the hull surface of 5±4 mm measured from a line, which starts on the said planing surface 20 cm in front of said end region and is tangent to the said end region, and extending backwards up to 20 cm.

6. The step shape as recited in claim 5 where the said planing surface is cambered or cupped in front of said end region with a hook angle of less than 7 degrees and said camber has a depth of 2 mm to 18 mm.

7. The step shape as recited in claim 6 where at least one said step may be angled its whole length between the transverse and the longitudinal direction of a hull.

8. The step shape as recited in claim 5, wherein the said surface region behind said step depth is cupped at a back end.

9. The step as recited in claim 5 further including a third region behind said second region whose depth in cm from the said line is less than the deeper of 1.5 cm or $1.5E\text{-}3\times(\text{length})^2$, where the length is the distance in cm from said planing surface to an end of said hull.

10. The step as recited in claim 5, further including a side part of the said step extending back toward the end of the hull, wherein said planing surface which abuts said side part of said step is cupped such that an attack angle at the intersection of the side part of said step and said planing surface is increased.

11. The step as recited in claim 10, where the said increase in attack angle perpendicular to said side step is 5° to 30° .

12. The step as recited in claim 5 further including a ventilation area between part of said planing surface and said second region.

13. A hull having a plurality of steps as recited in claim 5 one behind the other.

14. A step as recited in claim 5 wherein said step is located to maintain an optimum planing angle at planing speeds.

15. The step shape as recited in claim 5, wherein said angle at the end of said end region is approximately 20°.

16. A hull of a sailboard, surfboard or personal water craft with at least one step, said step being angled in a transverse direction to form a side step between a planing region near a fin or other means for which ventilation is undesirable, and a surface behind said step, said step and said side step comprising a first cambered planing surface with an end region adjacent to said planing surface with an end region adjacent to said planing surface with a positive second derivative shape of 0.3 to 3.0 ($cm^{-1}$) to form an angle at the end of said end region which is less than 90° , a second region of the hull directly behind said end region with depth into the hull surface of 5±4 mm measured from a line, which starts on the said planing surface 20 cm in front of said end region and is tangent to the said end region, and extending backwards up to 20 cm.

17. The hull in claim 16, where the region immediately in front of said step forms a cambered or hook angle in front of the step of 4° to 7° .

18. The hull as recited in claim 16 wherein said planing surface includes three or more slightly concave regions where there are cusps between said slightly concave regions directly behind the said step or steps and the regions near the fin or other said means and at the fin.

19. A step for a planing hull, said step including a side part of said step, said side part of said step extending toward a back end of said planing hull, a planing surface which abuts one lateral side of said side part of said step, wherein a portion of said planing surface is cupped such that an angle of attack of said planing surface is increased adjacent to said step and said side part of said step, a surface behind said step which abuts another lateral side of said side part of said step, a portion of said surface behind said step being cupped to form a cusp with said cupped portion of said planing surface, said cusp being between said planing surface and said surface behind said step, said cusp extending below said planing surface, wherein, at planing speeds, said cupped portions of said planing surface and said cusp decrease flow of water across said side part of said step and decrease water flow and/or vortex flow from said planing surface onto said surface behind said step to de-wet said surface behind said step.

20. The step design in claim 19, where the said increase in attack angle perpendicular to said side step is 5° to 30°.

* * * * *